United States Patent [19]

Grace et al.

[11] Patent Number: 4,589,305

[45] Date of Patent: May 20, 1986

[54] COMPOSITE TOOTH-FORMING RACK AND METHOD FOR MAKING SAME

[76] Inventors: Wallace C. Grace, 825 Laurier Dr., LaSalle, Ontario, Canada, N9I 1M9; Walter P. Boychuk, 2930 Orion Cr., Windsor, Ontario, Canada, N9E 2Z4

[21] Appl. No.: 558,133

[22] Filed: Dec. 5, 1983

[51] Int. Cl.[4] ..... B21K 5/20

[52] U.S. Cl. ..... 76/107 R; 76/101 R; 72/88; 72/469; 74/422; 228/231

[58] Field of Search ..... 76/107 R, 101 R; 72/88, 72/469, 90; 74/422, 448, 89.17; 29/402.16; 228/119, 263.15, 231, 232

[56] References Cited

U.S. PATENT DOCUMENTS 3,319,501 5/1967 Risher ..... 76/107 R 3,327,569 6/1967 Prutton ..... 76/107 R 4,028,921 6/1977 Blue ..... 72/88

4,444,353 4/1984 McMurray et al. ..... 228/231

*Primary Examiner*—Roscoe V. Parker

[57] ABSTRACT

A composite tooth-forming rack useful for pressure forming teeth in a workpart is provided and includes an elongated carbon steel base and an elongated toothed insert of high speed steel joined to the base by a metallic bonding agent, such as silver solder, having a melting temperature below the solution annealing temperature of the high speed steel insert and above the tempering temperature thereof so that the rack can be heat treated in conventional fashion to develop the required hardness in the toothed insert and at the same time bond the base and insert together.

13 Claims, 6 Drawing Figures

COMPOSITE TOOTH-FORMING RACK AND METHOD FOR MAKING SAME

FIELD OF THE INVENTION

The present invention relates to tooth-forming racks which are used to pressure form splines or teeth in workparts, such as power transmission members, and to methods for their manufacture.

BACKGROUND OF THE INVENTION

In one cold forming process for forming splines or teeth in cylindrical workparts, the workpart is rotatably mounted between a pair of slidable toothed racks or dies. The racks are slid past the workpart in opposite directions and are spaced apart so as to pressure form tooth shapes in the workpart as they are slid therepast. Such a process is well known.

It has been common in the past to machine each rack body from a bar or billet of high speed steel such as M2 steel. The machined rack body is then subjected to a high temperature solution anneal or hardening treatment (e.g. 2050° F.) followed by multiple lower temperature tempering treatments (e.g. 1025°–1045° F.) to develop the required high hardness ($R_c$ 60–62) in the rack body for the pressure forming operation. Thereafter, sections of forming teeth are precision ground into the rack. When the toothed sections of the rack have worn out of tolerance through use, the rack in the past has been reground to provide new toothed sections. However, there is a point at which insufficient stock is left for regrinding and continued use of the rack and the rack must be scrapped. The portion that must be discarded is oftentimes approximately 50% of the original rack bulk and discarding this material is quite costly, given the fact that it is expensive high speed steel. The Blue U.S. Pat. 4,028,921 issued June 14, 1977 discloses a tooth-forming rack comprising a plurality of high speed steel toothed inserts releasably mounted by cap screws to an elongated insert holder member made of less expensive carbon steel. When a particular toothed insert becomes worn beyond tolerance, it is removed from the insert holder by unscrewing the cap screws and thrown away. A new insert is then attached by the cap screws.

SUMMARY OF THE INVENTION

In a typical working embodiment of the invention, the composite tooth-forming rack includes an elongated base, such as for example a carbon steel base, and an elongated toothed insert, such as for example an expensive high speed steel, hardenable to high hardness compared to the base by solution annealing followed by tempering, joined or laminated together by a metallic bonding agent, preferably silver solder, having a melting temperature below the solution annealing temperature of the insert and above the tempering temperature thereof. In this way, the composite rack can be heat treated in conventional manner to develop proper high hardness in the insert and at the same time effect bonding of the base and insert together.

Preferably, the base and insert are joined at a machined tongue and groove joint therebetween by such a bonding agent.

DESCRIPTION OF PREFERRED EMBODIMENTS

Figure 1:
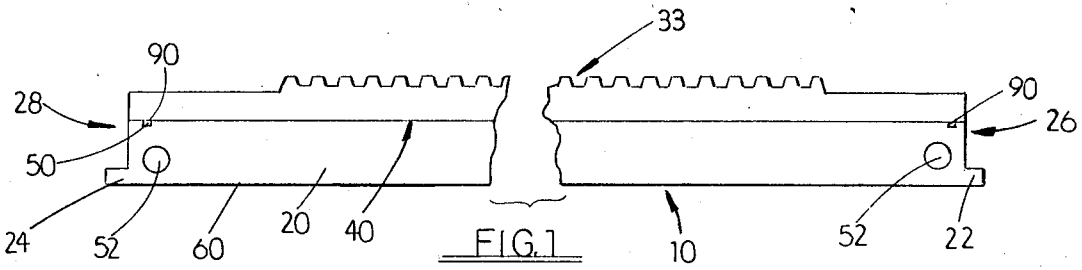
FIG. 1 is a schematic side elevation of the composite toothed rack of the invention.

As seen in FIG. 1, the composite tooth-forming rack 10 is comprised of a generally elongated base 20 having flanges 22 and 24 at the leading end 26 and trailing end 28, respectively, by which the rack is mounted in the machine and a single generally elongated toothed insert 30 mounted atop the base and having forming teeth 32 on working surface 33 extending transverse to the rack longitudinal axis and arranged to gradually deform a workpart as the rack is slid therepast in known fashion. The base 20 and toothed insert 30 are joined together at a tongue and groove joint 40 extending therealong and described in more detail with respect to FIGS. 2–5.

As can be seen in FIGS. 2–5, the base 20 includes a joint surface 42 in the form of a groove 44 defined by upstanding lateral shoulders 46 and planar surface 48 extending therebetween. The joint surface 42 also includes transversely-extending grooves 50 adjacent the leading end 26 and trailing end 28 spaced slightly inboard thereof. These grooves 50 extend across the entire width of the joint surface, i.e., through the lateral shoulders 46 and planar surface 48, for purposes to be described.

The base 20 also includes standard rack mounting holes 52 extending transversely therethrough and adapted to receive bolts (not shown) used to attach the rack in a splining machine as is well known. Drilled holes 56 with counterbores 58 are also provided and extend upward from the bottom support surface 60 of the rack through the planar surface 48 for purposes to be described. In a splining machine, the rack bottom surface 60 is usually clamped against a sliding tool holder member by means of flanges 22, 24.

The base 20 is made of relatively inexpensive carbon steel such as SAE 8620 although other grades of carbon steel can be used. Generally, the carbon steel base does not exhibit a hardness above about $R_c$-38–45.

The insert 30 includes a joint surface 62 in the form of a tongue defined by lateral recessed flats 64, connected by lateral edges 66 to a planar surface 68. Of course, the joint surface 62 is machined to have a tongue which is complementary to the groove of the base so as to mate therewith when the base and insert are assembled.

The insert 30 is made of more expensive high hardness steel such as for example M2 high speed or tool steel, heat treatable or hardenable by solution annealing and tempering to an $R_c$ of at least approximately 60. Typical of such steels are those alloyed with tungsten, molybdenum and/or chromium so as to be hardenable to high hardness by solution annealing and tempering.

Figure 5:
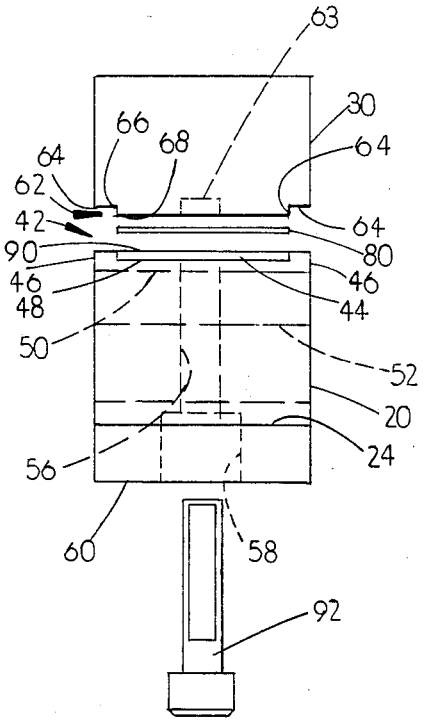
FIG. 5 is an exploded end elevation, similar to FIG. 3, showing the rack components prior to temporary assembly for heat treatment and bonding.

FIG. 5 shows the rack components ready for assembly. In particular, the base 20 and insert 30 are in spaced relation with the tongue and groove in position to be mated. Interposed between the base 20 and insert 30 is a strip or layer 80 of conventional silver solder which melts in the range of about 1300° F. to about 1500°, the particular solder used melting at 1315° F. It is apparent that the solder strip 80 is of a width to fit between lateral shoulders 46 in the joint surface 42 of the base. The length of the strip 80 is selected to fit between carbon steel filler strips 90 which are received in the transverse grooves 50 adjacent the leading end and trailing end of the base. The filler strips 90 together with the lateral shoulders 46 function to contain the silver solder in the joint in its molten state achieved during subsequent heat treatment of the assembled rack as described hereinafter.

Flux (not shown) is disposed on opposite sides of the solder strip 80 between the base 20 and insert 30 for known purposes.

Figure 3:
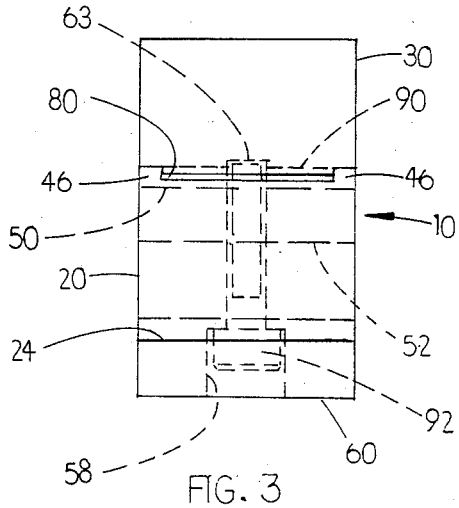
FIG. 3 is an end elevation of the rack of FIG. 2.

FIG. 3 illustrates the assembled rack 10 ready for heat treatment. Assembly is achieved by cap screws 92 which are inserted into drilled holes 56 and threaded into shallow tapped holes 63 in the insert joint surface 62 which holes 56, 63 are coaxially aligned in the assembled position. As shown, the heads of the cap screws 92 are received within counterbores 58 in the bottom support surface 60 of the base 20. The cap screws 92 are used only to temporarily hold the assembled rack components during heat treatment of the rack during which the solder bond between the base and insert is also effected. The number and location of cap screws 92 and associated threaded holes in the base and insert will depend upon the width and length thereof. After heat treatment, the cap screws 92 are removed.

The assembled rack is then subjected to a conventional heat treatment in a series of salt baths to develop the required properties in the high speed steel insert. For example, for the insert 30 made of M2 steel, the heat treatment comprises a preheat step from 1000° F. to 1550° F. and then a solution anneal step at 2050° F. for 8–12 minutes. During the solution anneal, the silver solder (melting temp. 1315° F.) melts, flows and wets the planar surfaces 48, 68. The assembly is then quenched to about 1025° F. in a salt bath and subjected to three salt bath tempering treatments at 1025° F. for 2 hours, 1045° F. for 2 hours and 1025° F. for 2 hours to develop a hardness of $R_c$-60–62 in the M2 steel insert 30. Of course, the silver solder solidifies when the temperature falls below its melting temperature in the tempering steps and effects metallurgical bonding between the base and insert at the tongue and groove joint.

By selecting a solder with an appropriate melting temperature between the solution anneal or hardening temperature and tempering temperature of the high speed steel insert 30, bonding of the base and insert can be effected during the conventional hardening heat treatment employed in the past without a separate bonding step being required.

Figure 6:
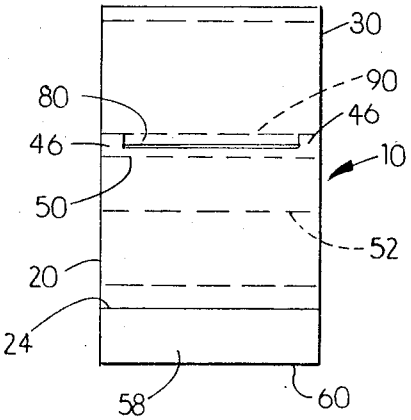
FIG. 6 is an end elevation of the composite toothed rack of FIG. 1.
Figure 2:
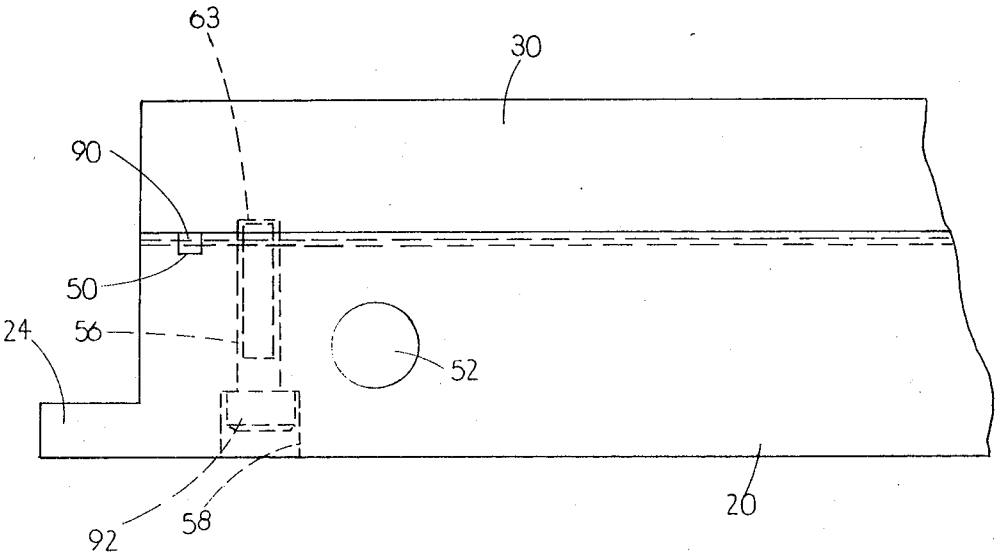
FIG. 2 is an enlarged elevation of the rack at the trailing end and temporarily assembled for heat treatment and bonding.
Figure 4:
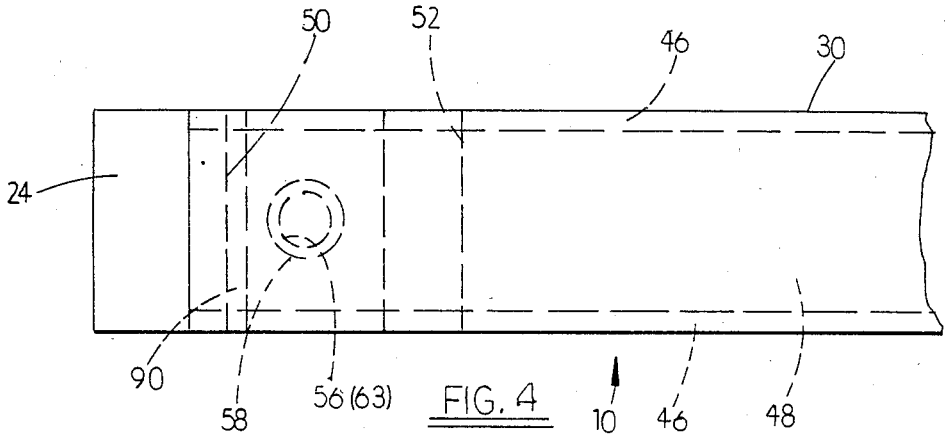
FIG. 4 is a top elevation of the rack of FIG. 2.

After cooling to ambient temperature, the cap screws 92 are removed from the bonded rack. The rack is then subjected to grinding operations to form the transversely-extending teeth 32 along the working surface 33, FIG. 6.

Of course, the method described hereinabove can also be used to make a rack using a reclaimed base and high speed steel insert, the teeth of which have been worn out of tolerance through use. In this situation, the used insert would be ground or otherwise machined to remove the worn teeth and inspected for cracks. If satisfactory, the insert and rack would be assembled as described hereinabove for bonding in accordance with the method of the invention.

While the invention has been described by a detailed description of certain specific and preferred embodiments, it is understood that various modifications and changes can be made therein within the scope of the appended claims which are intended to include equivalents of such embodiments.

I claim:

1. A composite tool rack useful for pressure-forming a workpart, comprising a base and a tool insert made of a material heat-treatable to high hardness by solution annealing followed by tempering at a substantially lower temperature and attached to the base by a metallurgical bonding agent having a melting temperature substantially lower than the solution annealing temperature of the insert and above the tempering temperature thereof, whereby the insert is bonded to the base during the hardening heat treatment.

2. A composite tooth-forming rack useful for pressure forming teeth and the like in a workpart, comprising an elongated carbon steel base and an elongated toothed insert of high speed steel attached to the base by a metallic solder having a melting temperature substantially lower than the solution annealing temperature of the high speed steel insert and above the tempering temperature of said insert.

3. The rack of claim 2 wherein the metallic solder is a silver solder.

4. The rack of claim 3 wherein the silver solder has a melting temperature of about 1300° F. to about 1500° F.

5. A composite tooth-forming rack useful for pressure forming teeth and the like in a workpart, comprising an elongated base and an elongated toothed insert of steel heat treatable to high hardness by solution annealing and tempering and attached to the base at a metallurgically bonded tongue and groove joint using a metallic bonding agent with a melting temperature substantially lower than the solution annealing temperature of the insert and above the tempering temperature of said insert.

6. The rack of claim 5 wherein insert includes a machined tongue and the base includes a machined groove.

7. The rack of claim 5 wherein a transversely-extending slot is machined in the joint adjacent the leading end and trailing end of the rack and a filler strip is received in each slot to contain solder flow during bonding.

8. The rack of claim 5 wherein the metallic bonding layer is silver solder with a melting temperature of about 1500° F. to about 1500° F.

9. A method for making a composite laminated tool rack, comprising the steps of:

(a) assembling a base and an insert made of a material heat treatable to high hardness by solution annealing followed by tempering, including interposing a metallurgical solder therebetween having a melting temperature substantially lower than the solution annealing temperature of the insert and above the tempering temperature thereof, and (b) heat treating the assembled base and insert with the bonding agent therebetween at the insert solution annealing temperature and then at the tempering temperature thereof to provide for insert with said high hardness and at the same time bond the insert and base together.

10. In a method for making a composite laminated tooth-forming rack, the steps of:

(a) machining an elongated base and an elongated insert of a steel hardenable to high hardness compared to the base by solution annealing followed by tempering such that one of said base and insert has a tongue and the other has a complementary groove to receive the tongue, (b) assembling the base and insert together to form a tongue and groove joint therebetween including interposing a metallic bonding agent in the joint between the base and insert, said bonding agent having a melting temperature substantially below the solution annealing temperature of the insert and above the tempering temperature thereof, and (c) annealing the assembled base and insert at the insert solution annealing temperature and then tempering same at the tempering temperature of the insert whereby the insert is hardened and the bonding agent forms a metallurgical bond between the base and insert.

11. The method of claim 10 wherein in step (b) a solder along with flux is interposed in the joint between the base and insert.

12. The method of claim 11 wherein the solder is silver solder.

13. The method of claim 10 wherein in step (b) the base and insert are temporarily assembled by threaded screw means which are removed following step (c).

* * * * *